US011718930B2

(12) United States Patent
Dürnberger et al.

(10) Patent No.: US 11,718,930 B2
(45) Date of Patent: Aug. 8, 2023

(54) SPINNING DEVICE AND METHOD FOR SPINNING UP A SPINNING DEVICE, AND SPIN-UP DEVICE

(71) Applicant: LENZING AG, Lenzing (AT)

(72) Inventors: Franz Alfred Dürnberger, Lenzing (AT); Christoph Schrempf, Bad Schallerbach (AT); Christian Sperger, Schörfling (AT)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 170 days.

(21) Appl. No.: 16/754,965

(22) PCT Filed: Oct. 8, 2018

(86) PCT No.: PCT/EP2018/077362
§ 371 (c)(1),
(2) Date: Apr. 9, 2020

(87) PCT Pub. No.: WO2019/072779
PCT Pub. Date: Apr. 18, 2019

(65) Prior Publication Data

US 2020/0299864 A1 Sep. 24, 2020

(30) Foreign Application Priority Data

Oct. 12, 2017 (EP) ..... 17020468

(51) Int. Cl.
*D01D 5/18* (2006.01)
*D01D 5/02* (2006.01)
(Continued)

(52) U.S. Cl.
CPC ..... *D01D 5/02* (2013.01); *B65H 51/02* (2013.01); *B65H 54/00* (2013.01); *D01D 4/022* (2013.01);
(Continued)

(58) Field of Classification Search
CPC .. D01D 5/02; D01D 5/06; D01D 5/18; D01D 4/022; D01D 13/02; D01D 10/04; B65H 51/02; B65H 2701/3132
See application file for complete search history.

(56) References Cited

U.S. PATENT DOCUMENTS 2,228,155 A 1/1941 Serinis
3,008,183 A * 11/1961 Schuller ..... D01D 5/02 264/164
(Continued)

FOREIGN PATENT DOCUMENTS

CN 1124509 A 6/1996
CN 103147182 A 6/2013
(Continued)

OTHER PUBLICATIONS

International Search Report and Written Opinion issued in counterpart International Patent Application No. PCT/EP/2018/077362 (12 pages).
(Continued)

*Primary Examiner* — Emmanuel S Luk
(74) *Attorney, Agent, or Firm* — Venable LLP

(57) ABSTRACT

The invention shows a spin-up device (11, 51) and a method for spinning up a spinning device (1, 101) for the continuous extrusion of molded bodies (3) from a spinning solution (6), containing a solvent and cellulose dissolved in the solvent, wherein the molded bodies are extruded from the spinning solution (6) through spinnerets (7) of the spinning device (1, 101) in the form of a loose spinning curtain (2), the molded
(Continued)

bodies (3) of the loose spinning curtain (2) are combined into a molded body bundle (4) after the extrusion, and the molded body bundle (4) is, in a further step, fed to a draw-off member (10) of the spinning device (1, 101) in order to start a continuous extrusion of the molded bodies (3). In order to make the spin-up method simpler in terms of process technology and more reproducible, it is proposed to increase the tensile strength of at least some areas of the molded bodies (3) of the loose spinning curtain (2) after their extrusion and before combining them into a molded body bundle (4).

22 Claims, 4 Drawing Sheets

(51) Int. Cl.

| | |
|---|---|
| ***D01D 5/06*** | (2006.01) |
| ***D01D 10/00*** | (2006.01) |
| ***D01D 13/02*** | (2006.01) |
| ***D01D 4/02*** | (2006.01) |
| ***B65H 51/02*** | (2006.01) |
| ***B65H 54/00*** | (2006.01) |
| ***D01D 10/04*** | (2006.01) |

(52) U.S. Cl.
CPC ..... *D01D 5/06* (2013.01); *D01D 5/18* (2013.01); *D01D 10/00* (2013.01); *D01D 10/04* (2013.01); *D01D 13/02* (2013.01); *B65H 2701/3132* (2013.01)

(56) References Cited

U.S. PATENT DOCUMENTS

| | | | | | |
|---|---|---|---|---|---|
| 3,210,452 | A | * | 10/1965 | Howard | D01F 6/04 264/203 |
| 3,444,731 | A | * | 5/1969 | Nieuweboer | B65H 59/40 73/862.041 |
| 3,999,909 | A | * | 12/1976 | Schippers | D01D 5/02 425/72.2 |
| 4,246,221 | A | * | 1/1981 | McCorsley, III | D01F 2/00 264/203 |
| 4,261,943 | A | * | 4/1981 | McCorsley, III | D01F 11/02 264/136 |
| 4,416,698 | A | * | 11/1983 | McCorsley, III | C08J 3/096 106/200.2 |
| 4,702,876 | A | * | 10/1987 | Ebregt | D01F 6/605 264/184 |
| 5,354,524 | A | * | 10/1994 | Sellars | D01F 2/00 264/37.2 |
| H1592 | H | * | 9/1996 | Nicholson | A22C 13/0013 428/34.8 |
| 5,582,843 | A | * | 12/1996 | Sellars | B65H 63/065 250/559.12 |
| 5,601,765 | A | * | 2/1997 | Sellars | B65H 63/065 250/559.12 |
| 5,913,994 | A | | 6/1999 | Avril et al. | |
| 5,935,289 | A | * | 8/1999 | Arterburn | C03B 37/02 264/177.17 |
| 5,939,000 | A | | 8/1999 | White et al. | |
| 5,951,932 | A | | 9/1999 | White et al. | |
| 5,984,655 | A | * | 11/1999 | Schwenninger | D01F 2/00 425/464 |
| 6,852,413 | B2 | * | 2/2005 | Lee | B60C 9/0042 428/393 |
| 6,855,422 | B2 | | 2/2005 | Magill et al. | |
| 7,364,681 | B2 | * | 4/2008 | Zikeli | D01D 5/06 264/187 |
| 10,187,829 | B2 | | 1/2019 | Wang et al. | |
| 10,208,402 | B2 | * | 2/2019 | Zikeli | D01D 5/06 |
| 2003/0035951 | A1 | | 2/2003 | Magill et al. | |
| 2008/0048358 | A1 | | 3/2008 | Zikeli et al. | |
| 2010/0148404 | A1 | * | 6/2010 | Smida | D02G 3/36 425/66 |
| 2015/0223124 | A1 | | 8/2015 | Wang et al. | |
| 2019/0127887 | A1 | * | 5/2019 | Tascan | D01D 13/02 |

FOREIGN PATENT DOCUMENTS

| | | | |
|---|---|---|---|
| DE | 10117087 | A1 | 10/2001 |
| EP | 0574870 | A1 | 12/1993 |
| EP | 0746642 | B1 | 4/1999 |
| GB | 2301309 | A | 4/1996 |
| JP | S6015361 | A | 1/1985 |
| JP | H01124609 | A | 5/1989 |
| JP | 2009084757 | A | 4/2009 |
| JP | 5288091 | B | 9/2013 |
| KR | 20050020884 | A | 3/2005 |
| KR | 20150068985 | A | 6/2015 |
| WO | 94/28218 | A1 | 12/1994 |
| WO | 2018/146012 | A1 | 8/2018 |

OTHER PUBLICATIONS

Merriam-Webster Dictionary, https:/www.merrian-webster.com/dictionary/turntable (2022).

* cited by examiner

1

SPINNING DEVICE AND METHOD FOR SPINNING UP A SPINNING DEVICE, AND SPIN-UP DEVICE

The present application is a national-stage entry under 35 U.S.C. § 371 of International Patent Application No. PCT/EP2018/077362, published as WO 2019/072779 A1, filed Oct. 8, 2018, which claims priority to EP 17020468.9, filed Oct. 12, 2017, the entire disclosure of each of which is hereby incorporated by reference.

BACKGROUND OF THE INVENTION

Technical Field

The invention relates to a spinning device and a method for spinning up a spinning device for the continuous extrusion of molded bodies from a spinning solution containing a solvent and cellulose dissolved in the solvent, wherein the molded bodies are extruded from the spinning solution through spinnerets of the spinning device in the form of a loose spinning curtain, the molded bodies of the loose spinning curtain are, after the extrusion, combined into a molded body bundle, and the molded body bundle is, in a further step, fed to a draw-off member of the spinning device in order to start a continuous extrusion of the molded bodies.

Furthermore the invention relates to a spin-up device for the execution of the method.

Background of the Invention

Spinning devices of the type mentioned at the outset and the spinning methods performed therewith are known from prior art for the production of molded bodies such as fibers, filaments, sheets, etc. Particularly in the textile industry, said methods are used for the production of spun staple or continuous fibers. For the extrusion of the molded bodies, the spinning solution is, in such case, forced through a plurality of spinnerets.

Prior to the further treatment of the extruded molded bodies in subsequent method steps such as washing, pressing, drying, etc. which do not take place in the spinning device itself, the extruded molded bodies must be transported continuously out of the spinning device, for example, via a draw-off member. In order to feed the molded bodies to such a draw-off member, they must first be combined into a bundle.

Generally, it is mentioned that this first part of a spinning method is referred to as a spin-up or lace-up method or method for spinning up or lacing up a spinning device. Spinning up of a spinning device constitutes a first phase of a spinning method, which is to permit and/or initiate a continuous extrusion of molded bodies in the spinning method. Accordingly, the spin-up method comprises all method steps of a spinning method that are necessary between the end of a first continuous extrusion and a subsequent continuous extrusion, for example, after a stoppage of the spinning device or after spinning defects such as rupturing of a few molded bodies below the spinnerets have occurred.

WO 94/28218 A1 shows, for example, a spinning device of the type mentioned at the outset, wherein the spinning curtain extruded from the spinnerets is passed through a bottom-side opening of the spinning bath container. In this case, the bottom-side opening has a reducing effect on the diameter of the spinning curtain, whereby the molded bodies are combined into a molded body bundle. However, the very high immersion depths of the spinning bath containers disclosed in connection therewith make spinning up and manipulating the spinning curtain considerably more difficult. Therefore, such spinning devices suffer from a low degree of reproducibility of the spin-up method and a high susceptibility to spin-up defects that do not permit a satisfactory continuous extrusion of the molded bodies and often require renewed spinning up.

Spinning devices to facilitate the spin-up process are also known from prior art. EP 0 574 870 A1, for instance, shows a spinning device wherein the extruded molded bodies, after exiting the spinnerets in the form of a spinning curtain, are combined into a molded body bundle. This is accomplished by using a spinning funnel in the spinning bath of the spinning bath container, whose cross-section narrows in a downward direction and which has a narrowed bottom outlet opening. When the spinning curtain is passed through the spinning funnel, a molded body bundle is created when the molded bodies exit the spinning funnel, which facilitates the further handling of the molded bodies in the spinning device during spin-up. Nevertheless, such spinning funnels are disposed disadvantageously deep in the spinning bath container, which does not make handling by the operator easy. In addition, a shortcoming of such spinning devices is that high quantities of spinning bath liquid must at all times be flowing through the spinning funnel in the spinning bath container in order to ensure satisfactory functioning, which however causes turbulent currents in the spinning bath and adversely impacts the process conditions during the continuous extrusion of the molded bodies.

In order to remedy the above-mentioned disadvantages, EP 0 746 642 B1 describes a spinning device wherein a bundling element for bundling the molded bodies is provided in the form of a deflection element in the spinning bath container. While such devices help avoid the above-mentioned turbulent currents in the spinning bath, they make the spin-up process considerably more difficult, as they require initial, manual bundling of the spinning curtain into a molded body bundle by the operator in order to provide the molded bodies in the deflection element. However, this disadvantageously requires a high physical effort from the operator. In addition, such a spin-up method is highly susceptible to spin-up defects, more particularly to incomplete bundling of the spinning curtain.

DESCRIPTION OF THE INVENTION

It is therefore the object of the present invention to design a spin-up method of the type mentioned at the outset that is simpler in terms of process technology and more reproducible.

The invention solves the defined object by means of the features of a method for spinning up a spinning device for the continuous extrusion of molded bodies from a spinning solution comprising a solvent and cellulose dissolved in the solvent, wherein the molded bodies are extruded from the spinning solution through spinnerets of the spinning device in the form of a loose spinning curtain, the molded bodies of the loose spinning curtain are combined into a molded body bundle after the extrusion, and the molded body bundle is, in a further step, fed to a draw-off member of the spinning device in order to start a continuous extrusion of the molded bodies, wherein the tensile strength of the molded bodies of the loose spinning curtain, after their extrusion and before combining them into a molded body bundle, is increased in at least some areas.

If the tensile strength of the molded bodies of the loose spinning curtain, after their extrusion and before combining them into a molded body bundle, is increased in at least some areas, then the continuous extrusion of the molded bodies and bundling into a homogeneous molded body bundle can be improved and facilitated considerably, which particularly benefits the reliability of the spin-up method. After all, by increasing the tensile strength, the conditions are created that are necessary for bundling and/or grabbing the molded body bundle by using machinery. More particularly, the tensile strength of the molded bodies of the loose spinning curtain must be increased such that combining the molded bodies and feeding them to a draw-off member by using machinery is possible. After all, the extruded molded bodies, which substantially consist of not yet precipitated spinning solution extruded to form the molded bodies, exhibit a particularly low viscosity during and directly after the extrusion from the spinnerets. In fact, the low viscosity makes extruding the spinning solution through the spinnerets possible. However, on the other hand, the low viscosity causes a very low tensile strength of the molded bodies. Thus, the extruded molded bodies are unable to withstand the forces occurring during machine-based manipulation and will rupture. Thus, increasing the tensile strength in at least some areas makes it possible to provide a particularly simple and reliable method for spinning up a spinning device. As a further consequence, this also advantageously results in a steadier and more stable spinning process because the occurrence of spinning defects can be avoided.

Generally, it is noted that 'molded bodies' denotes the spinning dope extruded from the spinnerets and can, for example, be present in the form of filaments or sheets. Such molded bodies can subsequently be processed into final products such as staple fibers, continuous fibers, nonwoven fabrics, sheets, sleeves, powders, etc.

The invention can also prove particularly advantageous if the continuous extrusion of the molded bodies is performed according to the lyocell process and if the molded bodies are cellulosic molded bodies, more particularly cellulosic filaments, extruded through spinnerets of the spinning device from a spinning solution containing water, cellulose, and tertiary amine oxide. After all, in such a method, combining the molded bodies into the molded body bundle can already take place in the air gap between spinnerets and spinning bath, whereby better accessibility and thus a considerably simpler method are created.

'Machine-based manipulation' of the molded bodies generally denotes the combining of the molded bodies into the molded body bundle and the feeding of the molded body bundle to a draw-off unit. Such machine-based manipulation can preferably be carried out in a partly or fully automated manner or under human control.

If the tensile strength of the molded bodies is increased in at least some areas such that the molded bodies will substantially not rupture due to their own weight, then the reliability of the spin-up method according to the invention can be increased further. After all, if the tensile strength is at least so high that the molded bodies withstand loading with their own weight without rupturing, then a safe machine-based manipulation of the extruded molded bodies of the loose spinning curtain can be carried out. After all, the feeding velocities of a machine-based manipulation can be chosen such that they substantially correspond to the velocity of the extrusion of the molded bodies from the spinneret, which is why during such manipulation the molded bodies will always be subjected to a force that is smaller than the weight force generated by the own weight of the molded bodies. This way, it can be guaranteed that the tensile strengths of the extruded molded bodies are sufficiently high so that any deformations of the molded bodies caused by the acting manipulation forces can substantially be prevented.

If an area of engagement is created on the molded body bundle through the increase in tensile strength in at least some areas, then this can enable a particularly advantageous and simple handling of the molded body bundle in the spin-up method. After all, by forming an engagement area on the molded body bundle, it can be manipulated and subjected to further processing easily and reliably in subsequent method steps. Furthermore, the defined engagement area permits the automated, machine-based handling and manipulation of the molded body bundle. Furthermore, if the molded bodies have a viscosity in the engagement area that is increased 1.5-fold as compared to the spinning solution, then a particularly reliable handling of the molded body bundle can be guaranteed. To this end, the tensile strength of the molded bodies is, for example, increased in an area that, after bundling the molded bodies into the molded body bundle, substantially coincides with the engagement area. Thus, a safe and reliable handling of the molded body bundle, more particularly a machine-based, fully automatic manipulation, can be made possible.

The handling of the molded body bundle can be made yet more reliable if the molded bodies have a viscosity in their engagement areas that is increased 2-fold, more particularly 4-fold, as compared to the spinning solution.

The tensile strength of the molded bodies in the engagement area can, in this case, be advantageously increased such that the load carrying capacity per molded body until rupturing is at least 0.5 mN, more particularly at least 1 mN.

Furthermore, if an engagement area on the molded body bundle having a diameter from 1 to 20 cm, more particularly from 3 to 12 cm, is created, then the reproducibility of the spin-up method can be increased further. After all, such a molded body bundle can prove advantageous due to particularly reliable handling conditions, more particularly reliable machine-grippability, in further method steps.

If combining the molded bodies into the molded body bundle and/or feeding the molded body bundle to the draw-off member is done by machinery, then also the reliability and reproducibility of the spin-up method can be improved considerably. More particularly, spin-up defects such as ruptured molded bodies or undesired knotting/thickening caused by manually combining the molded bodies can be avoided. Thus, it can be prevented that renewed spinning up due to such spin-up defects becomes necessary. Furthermore, machine-based combining of the molded bodies and machine-based feeding of the molded body bundle to the draw-off member, respectively, can constitute a significant reduction in the work effort and physical effort required from the operating staff as compared to a manual spin-up method. Thus, a procedurally simple and reliable spinning up of a spinning machine can be ensured.

A particularly simple spin-up method can be created if an automatic gripping device grabs the molded body bundle and, by using machinery, feeds it to the draw-off member of the spinning device. In this case, an automatic gripping device may, for example, be a gripper on a manipulator arm, which grabs the molded body bundle automatically after having been twisted, transports it to the draw-off member by displacing the manipulator arm, and provides it in the draw-off member (for example, by chucking, clamping, fastening, etc.). In this case, the manipulator arm that provides the molded body bundle in the draw-off member should advantageously be attuned, in terms of both moving velocity and motion profile, to the extrusion of the molded bodies, more particularly to the draw-off velocity of the molded bodies. Excessively fast movements or unfavorable draw-off angles in the motion path can in turn lead to spin-up defects, more particularly to causing that molded bodies in the spinning curtain rupture, which requires that the spin-up process needs to be carried out again. By virtue of the spin-up method according to the invention, more particularly by virtue of the increased tensile strength of the molded bodies, the above-mentioned spin-up defects can be avoided, and, accordingly, a spin-up method having a high degree of reproducibility can be created which can also be executed fully automatically and can offer a significant reduction of the effort required in the course of the process from the operator of the spinning system as compared to known methods.

Furthermore, a high level of process safety can be guaranteed if the gripping device advantageously grabs the molded body bundle at the formed engagement area.

Furthermore, the spin-up method can be designed as being yet more reliable if the molded fiber bundle, after having been grabbed by the automatic gripping device, is cut off. Advantageously, the fiber body bundle is, in this case, cut off underneath the engagement area so that the lower part of the molded body bundle is severed. This way, inserting and placing the cut molded body bundle around the deflection member in the spinning bath container, as well as subsequent feeding of the molded body bundle to the draw-off member can be facilitated considerably.

If the molded bodies are cooled after their extrusion in order to increase their tensile strength, the reliability of the spin-up method can be increased in a technically particularly simple manner. After all, by cooling the molded bodies in at least some areas, the viscosity of the spinning dope extruded to form the molded bodies can be increased and thus sufficient tensile strength in the molded bodies can be achieved in order to permit the machine-based manipulation of the molded bodies and the molded body bundle, respectively.

The above-mentioned advantages can be achieved in a particularly simple manner if the temperature of the molded bodies after cooling is at least 10° C. lower than the temperature of the spinning solution. For example, if the molded bodies are extruded according to a lyocell process, a decrease in the temperature of the molded bodies, particularly directly after the extrusion from the spinning solution, by 10° C. can cause at least a twofold increase in viscosity. It is particularly preferred to cool the molded bodies in at least some areas by at least 20° C., more preferably by at least 30° C., as compared to the spinning solution. This way, a sufficiently high tensile strength can be achieved in the molded bodies.

The method can be designed as being very reliable if cooling of the molded bodies is carried out by blowing a stream of cooling air at them in at least some areas. The stream of cooling air used in this case can preferably be a stream of air having a humidity content, more particularly of greater than 5%. After all, the continuous stream of cooling air can bring about reliable cooling of the molded bodies after their extrusion from the spinnerets.

The method can also be designed as being very reliable, if cooling of the molded bodies is carried out by spraying at least some areas with a cooling liquid. Alternatively, it is also possible to cool the molded bodies by immersing at least some areas of them in a cooling liquid. In this case, the cooling liquid is preferably an aqueous solution including for example water or solvent. After all, applying a cooling liquid to the molded bodies can achieve particularly fast and reliable cooling and thus an increase in strength of the molded bodies.

The above-mentioned advantages can be improved further if the cooling liquid contains a coagulant for the dissolved cellulose. For example, if the molded bodies are produced according to a lyocell process, then the coagulant can be a mixture of water and tertiary amine oxide. By virtue of the coagulant, the strength of the molded bodies can be increased further so that a particularly reliable machine-based and/or automated manipulation of the molded bodies is made possible.

If the molded bodies are combined into the molded body bundle by twisting the spinning curtain around a torsion axis, then machine-based bundling into a homogeneous molded body bundle can be carried out in a procedurally simple manner. For the torsion of the spinning curtain, the various molded bodies are twisted around a common point of contact with one another so that the compact molded body bundle is created at the point of contact. The torsion of the spinning curtain, that is, the twisting of the various molded bodies around the common point of contact, can also have a particularly advantageous effect in favor of a low defect rate during bundling the molded bodies, since almost all molded bodies can be reliably combined in the bundle. Furthermore, this can be done with a considerably lower physical effort. In addition, in the known prior art methods for spinning up spinning devices, the insufficiently fast removal of the molded bodies following their extrusion from the spinnerets can, more particularly, cause an accumulation of the molded bodies and thus bloating of the spinning curtain during spin-up. During bloating of the spinning curtain, individual molded bodies in the spinning curtain can in turn stick to one another, which has a particularly negative impact on the integrity and homogeneity of the molded body bundle. The torsion of the spinning curtain can overcome these disadvantages in that, more particularly, not only a compact molded body bundle is created, but in that the torsion can also ensure a continuous, well controllable removal of the molded bodies from the spinnerets, which can reliably prevent the molded bodies from accumulating and the spinning curtain from bloating.

Twisting the spinning curtain into the molded body bundle is particularly easy to do if the torsion axis is substantially parallel to the extrusion direction of the extruded molded bodies. Furthermore, if the torsion axis passes through the center of the spinning curtain, then it can be ensured that the torsion of the spinning curtain acts evenly and symmetrically on all molded bodies. Thus, in the course of spinning up, it is possible to create a particularly homogeneous molded body bundle devoid of internal stresses, which can further decrease the susceptibility to spin-up defects. This makes it possible to provide a particularly reliable and reproducible spin-up method.

The above-mentioned advantages are particularly easy to achieve by process technology, if the torsion means is formed as a rotatable turntable and the rotation axis of the turntable extends substantially parallel to the extrusion direction of the molded bodies.

Alternatively to twisting the spinning curtain around a torsion axis, machine-based bundling into a homogeneous molded body bundle can also be carried out in a procedurally simple manner if the molded bodies are combined into the molded body bundle by encircling the spinning curtain with a sling and pulling the sling tight. After all, by encircling the loose spinning curtain with a sling and subsequently pulling it tight a compact molded body bundle can be reliably created. By encircling it with a sling, the entire spinning curtain can reliably be encompassed and bundled at a well-defined point of contact. Furthermore, encircling can be done very quickly, which further benefits automated processing.

Furthermore, machine-based bundling into a homogeneous molded body bundle can be carried out in a procedurally simple manner if the molded bodies are combined into the molded body bundle by passing the spinning curtain through a funnel of decreasing cross-section.

Furthermore, the invention relates to a spin-up device for spinning up a spinning device, including a bundling device for bundling of molded bodies extruded from the spinnerets of the spinning device into a molded body bundle.

Therefore, it is another object of the invention to improve a spin-up device of the aforementioned type such that the method for spinning up the spinning device can be performed easily and reproducibly and with little physical effort.

The invention solves the defined object regarding the spin-up device by means of the features of a spin-up device for spinning up a spinning device comprising a bundling device for bundling of molded bodies extruded from the spinnerets of the spinning device into a molded body bundle wherein the spin-up device includes a first manipulator arm with a first end effector, the first end effector including a gripper for grabbing a molded body bundle.

If the spin-up device includes a first manipulator arm with a first end effector, then a stable spinning device can be created which permits simple and reproducible spinning up. In this case, the spin-up device can, more particularly, perform the spinning up of the spinning device in a machine-based manner so as to reduce the physical and motor effort required from the operators of the spinning device. While the known spinning devices mentioned at the outset require a tremendous physical effort in order to provide the molded body bundle extruded from the spinnerets in a draw-off member of the spinning device during the spin-up procedure, the physical effort required in the spinning device according to the invention is comparatively low, thus easing the burden on the operators significantly. Furthermore, the spinning device according to the invention can prove advantageous due to a great ease of handling and high operating safety. The handling of the spinning device can be simplified further if the first end effector includes a gripper for grabbing a molded body bundle. In this case, the gripper on the first manipulator arm can be configured such that it is able to reliably grab the molded body bundle and feed it to a draw-off member of the spinning device. Such a gripper can be, for example, a mechanical, pneumatic, or adhesive gripper such as a one-finger, two-finger, or multi-finger gripper, a suction gripper, or, for example, a nailboard gripper. The transport of the molded body bundle from the spinnerets to the draw-off member can be performed by displacing the first manipulator arm, more particularly along freely selectable trajectories in space. In this case, in a method for spinning up the spinning device, the comparatively physically strenuous and difficult-to-reproduce steps of manually inserting the molded body bundle can be dispensed with. Not only does this represent a significant reduction of the physical effort required from the operators of the spinning device, but it can also contribute greatly toward enhancing safety against errors in operating the spinning device. Thus, the spin-up device according to the invention makes partially or fully automated spinning up of a spinning device possible.

Generally, it is also mentioned that the spin-up device according to the invention is particularly preferred as suited for spinning up a spinning device for the extrusion of cellulosic molded bodies from a spinning solution containing water, cellulose, and tertiary amine oxide.

Furthermore, if the spin-up device includes a second manipulator arm with a second end effector, the second end effector including the bundling device, then a particularly flexible spin-up device with a bundling device can be created, which bundling device is thus designed as displaceable between a use position and a rest position as needed. Accordingly, the spin-up device can react flexibly to the requirements of the method: for example, the bundling device can, when not in use, be displaced into a rest position, thus avoiding undesired interference by the bundling device in the spinning device. Thus, the bundling device can be retracted and advanced between the spinnerets and the spinning bath container, depending on the stage of the process. This way, a more reliable spinning device can be created.

Furthermore, a structurally simple bundling device can be created if it is formed by a rotation device. Furthermore, if the rotation device includes a rotatable means, and if the rotatable means is configured as a torsion means for the torsion of the molded bodies, then a particularly stable and simple spin-up device for a spinning device can be created, which can, more particularly, further simplify a method for spinning up the spinning device. In this case, the rotation device with the torsion means can, more particularly, be configured for receiving ends of the extruded molded bodies from the loose spinning curtain so that the ends of the molded bodies can be deposited on the torsion means and a torsion of the spinning curtain is generated by the rotating motion of the torsion means. The rotating motion of the torsion means and the associated torsion of the spinning curtain into a molded body bundle can thus replace the difficult step of bundling the molded bodies with a structurally very simple device.

The reliability of the spin-up device can be increased further if the torsion means includes holding elements to increase the adhesion between the molded bodies and the torsion means. This is particularly the case if the holding elements are formed as hooks.

Furthermore, if the rotation axis of the torsion means is substantially parallel to the extrusion direction of the molded bodies, then the torsion means can provide a reliable and low-stress torsion of the molded bodies around a common point of contact.

If the torsion means is formed as a turntable, then the torsion of the extruded molded bodies can be achieved in a structurally very simple manner. This is particularly the case if the turntable is configured such that it can be rotated substantially parallel to the extrusion direction of the molded bodies extruded from the spinnerets. After all, in this case, a rotation device for the torsion of the loose spinning curtain consisting of extruded molded bodies around a torsion axis in parallel to the extrusion direction of the molded bodies can be created which is capable of producing a compact molded body bundle in a particularly stable and reliable manner. Thus, the overall reliability and stability of the spinning device can be increased further. This is particularly the case if the torsion means is configured for twisting the extruded molded bodies around a common torsion axis and if the torsion axis of the molded bodies coincides with the rotation axis of the torsion means.

The handling of the molded body bundle by the spin-up device can be improved further if the spin-up device also includes a cutting device for cutting off the molded body bundle. Preferably, the cutting device can be provided on the first manipulator arm and, more preferably, be operatively connected to the gripper such that cutting off the molded body bundle after a successful grab procedure by the gripper will be carried out automatically.

Another object of the invention is to make a spinning device of the type mentioned at the outset more reliable and to facilitate spinning up of the spinning device.

The invention solves this object by providing a spinning device for the continuous extrusion of molded bodies, more particularly for the extrusion of cellulosic molded bodies from a spinning solution containing water, cellulose, and tertiary amine oxide, including at least one spinning bath container containing spinning bath, spinnerets associated with the spinning bath container for the extrusion of the molded bodies from the spinnerets into the spinning bath, and a spin-up device for spinning up the spinning device according to the spin-up device described herein for spinning up a spinning device comprising a bundling device for bundling of molded bodies extruded from the spinnerets of the spinning device into a molded body bundle wherein the spin-up device includes a first manipulator arm with a first end effector, the first end effector including a gripper for grabbing a molded body bundle. In one embodiment, the spin-up device may include a second manipulator arm with a second end effector which includes the bundling device. In a further embodiment, the bundling device of the spin-up device may include a rotatable means, formed as a torsion means for twisting the molded bodies around a torsion axis, whereby the molded bodies are combined into the molded body bundle.

If the spinning device also includes a cooling device for cooling of at least some areas of the extruded molded bodies, then the spinning device can make spinning up particularly reliable and reproducible.

SHORT DESCRIPTION OF THE DRAWINGS

Hereinafter, the embodiments of the invention are described with reference to the drawings, wherein.

EXAMPLES

Figure 1:
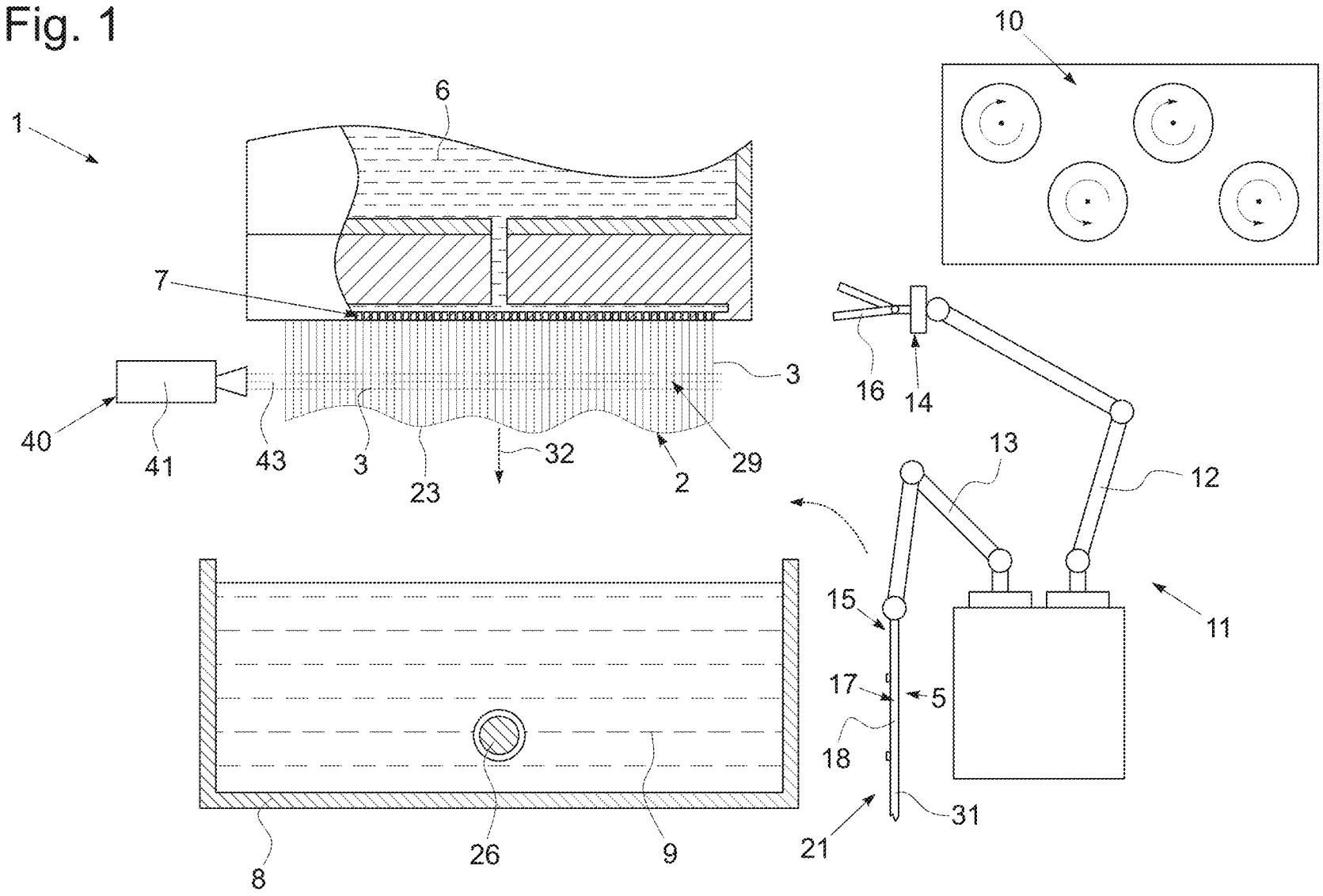
FIG. 1 shows a partially broken side view of the spinning device according to the invention prior to the execution of the method according to the invention for spinning up the spinning device according to a first embodiment.
Figure 2:
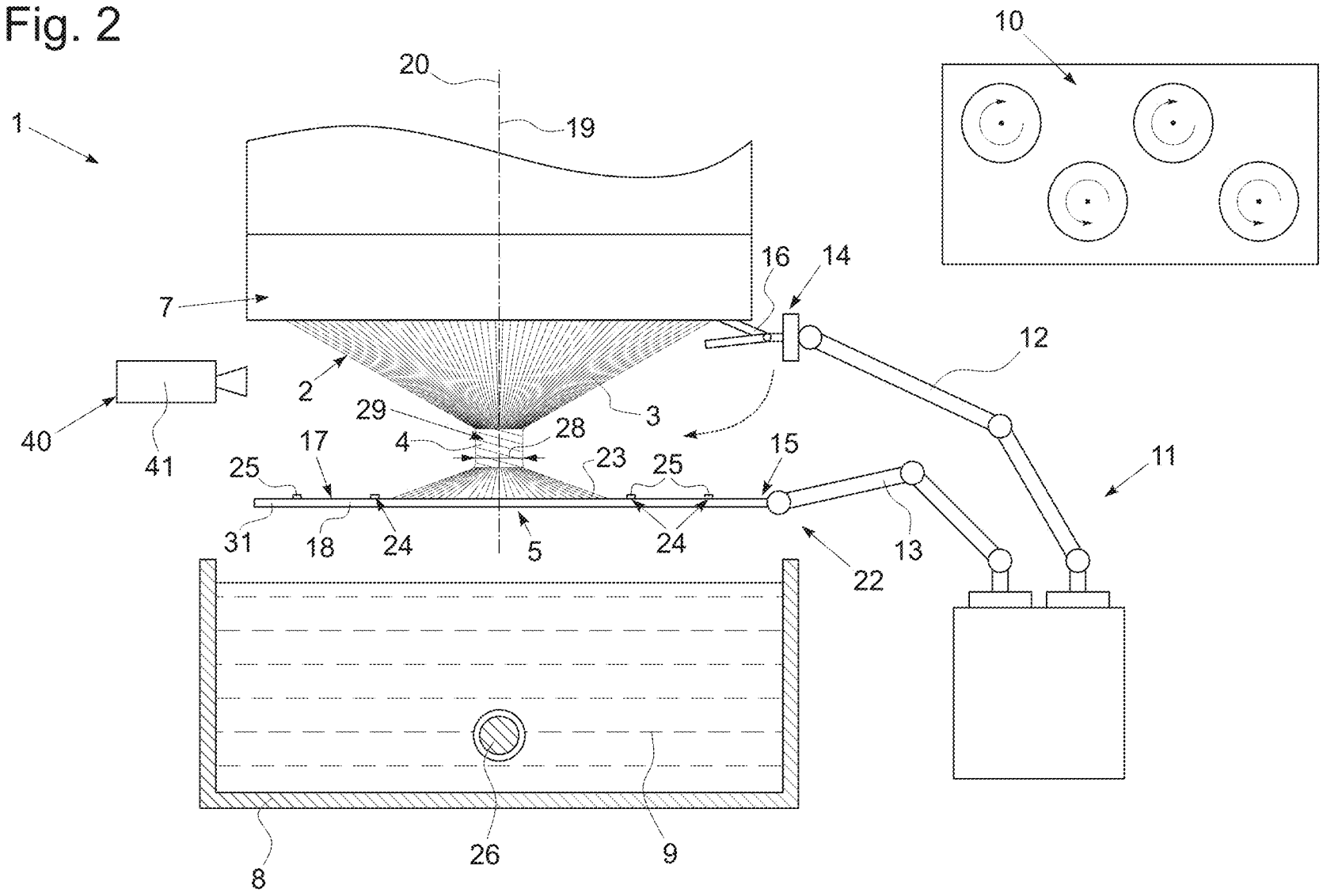
FIG. 2 shows a schematic view of the method according to the invention for spinning up the spinning device according to the first embodiment during a first method step.
Figure 3:
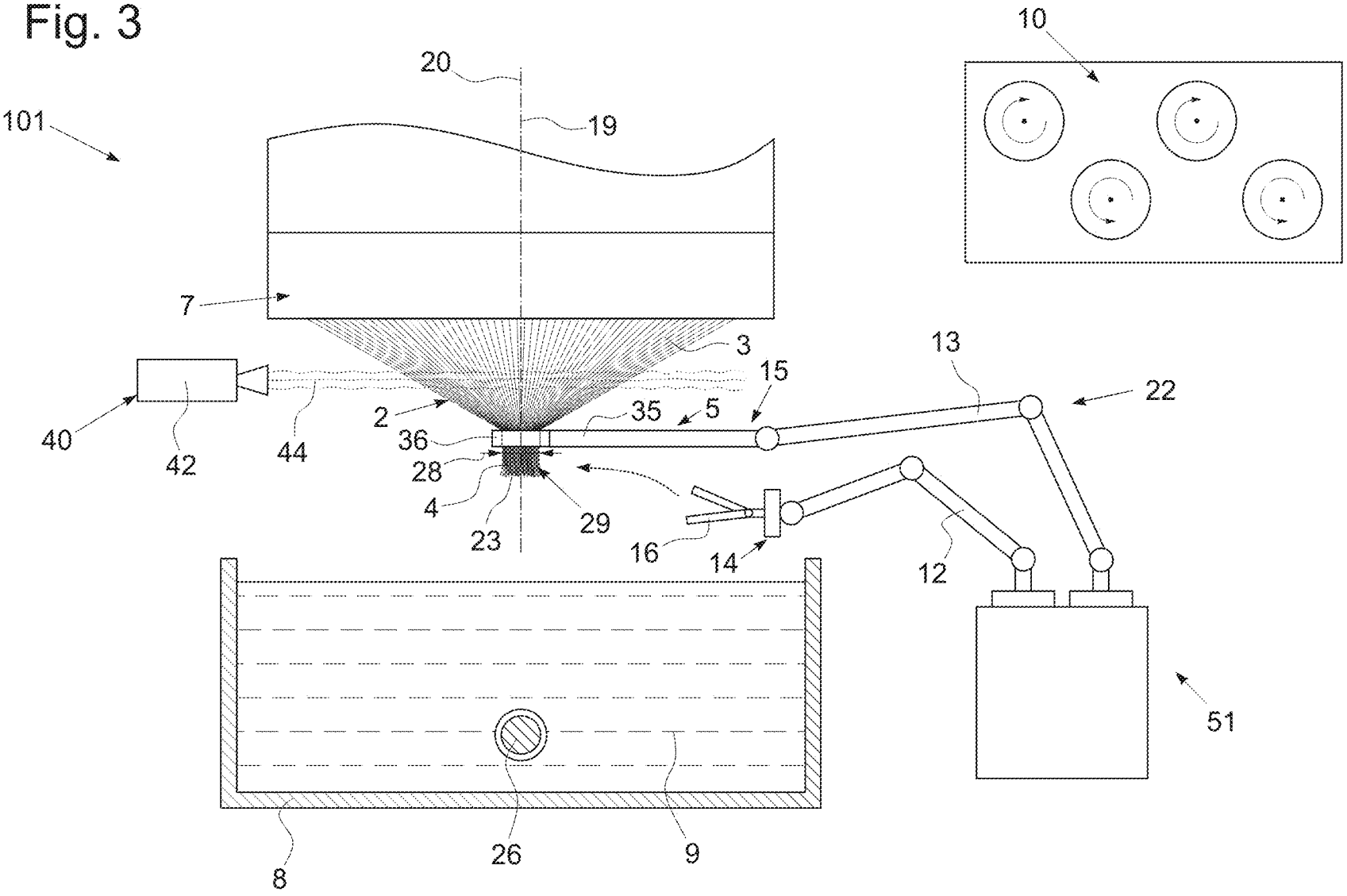
FIG. 3 shows a schematic view of the method according to the invention for spinning up the spinning device according to a second embodiment during a first method step.

Referring to FIGS. 1 to 4, spinning devices 1, 101 according to a first and a second embodiment of the invention are shown in various stages of the spin-up process. FIG. 1 shows the spinning device 1 with the loose spinning curtain 2 of extruded molded bodies 3 prior to spin-up, i.e., before the molded bodies 3 are combined into a molded body bundle 4 in a bundling device 5 as shown in FIGS. 2 and 3. Furthermore, the spinning device 1 includes a spinning solution 6 that is extruded through a plurality of spinnerets 7 to form the molded bodies 3. In this case, the spinning solution 6 is preferably a solution containing water, cellulose, and a tertiary amine oxide. Underneath the spinnerets 7, a spinning bath container 8 is provided that contains a spinning bath 9. Preferably, a mixture of water and a tertiary amine oxide is used as the spinning bath 9.

Furthermore, the spinning device 1 includes a strengthening device 40 in order to increase the strength of the extruded molded bodies 3 in at least some areas before combining them into the molded body bundle 4. For example, the strengthening device 40 can be a cooling device 41 that applies cooling liquid 43 to the extruded molded bodies 3 and increases their strength by cooling them. Alternatively or additionally to cooling, the strengthening device 40 can also apply a coagulant to the molded bodies 3, which precipitates the cellulose dissolved in the molded bodies 3 and thus also leads to an increase in strength.

FIG. 3 shows an alternative spinning device 101 that includes another cooling device 42 as the strengthening device 40. In this case, the cooling device 42 generates a cooling air stream 44 that flows over the extruded molded bodies 3 and cools them in at least some areas, whereby their strength is increased.

The cooling liquid 43 and the cooling air stream 44, respectively, are directed toward the extruded molded bodies 3 by the respective cooling device 41, 42 and produce an engagement area 29 of higher strength on the molded bodies 3, where the molded bodies 3 have at least 1.5 times the viscosity of the spinning solution 6. Preferably, the engagement area 29 is in the area of the smallest diameter 28 of the molded body bundle 4 after combining as shown in FIGS. 2 and 3.

Figure 4:
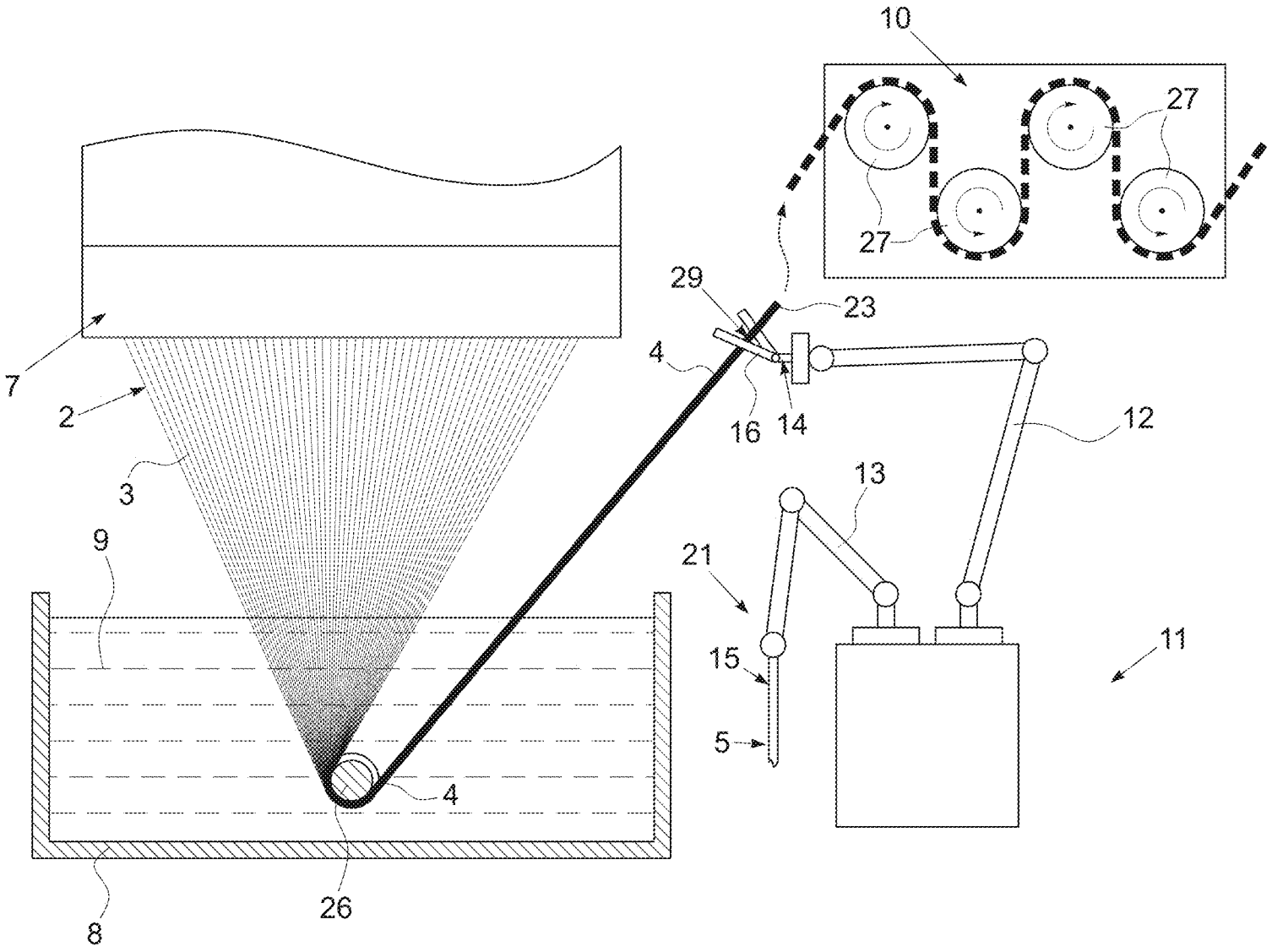
FIG. 4 shows a partially broken side view of the spinning device according to the invention after completion of the spin-up method.

FIG. 4, for its part, shows the spinning device 1 after spin-up. Accordingly, the molded bodies 3 have been combined into a molded body bundle 4 by the bundling device 5, and the molded body bundle 4 is being transported continuously by a draw-off member 10 of the spinning device 1, whereby a continuous extrusion of molded bodies 3 from the spinnerets 7 is taking place.

As can also be seen in FIGS. 1 to 3, each of the spinning devices 1, 101 includes, according to a first and a second embodiment of the invention, a spin-up device 11 and 51, respectively, for executing the method for spinning up the spinning device 1, 101. Each of the spin-up devices 11, 51, in turn, comprises a bundling device 5, a first manipulator arm 12, and a second manipulator arm 13. On the first manipulator arm 12, a first end effector 14 is provided, which end effector 14 is formed as a gripper 16. In this case, the gripper 16 is configured such that it can force-fittingly enclose and grab the molded body bundle 4. Furthermore, the gripper 16 is movably and controllably connected to the first manipulator arm 12. In connection with the free movability of the manipulator arm 12, the gripper 16 can move the grabbed molded body bundle 4 along nearly any given trajectory.

As shown in FIGS. 1 and 2, the spin-up device 11 includes, according to the first embodiment, a rotation device 17 that causes the torsion of the molded bodies 3 in the loose molded body curtain 2 and thus the combining of the molded bodies 3 into the molded body bundle 4. To this end, the rotation device 17 includes a rotatable torsion means 18 which is preferably formed as a turntable 31, the torsion means 18 and the turntable 31, respectively, being provided as a second end effector 15 on the second manipulator arm 13 and performing the function of the bundling device 5. The rotation axis 19 of the torsion means 18 and thus the torsion axis 20 of the spinning curtain 2 extends, more particularly, parallel to the extrusion direction 32 of the molded bodies 3 in the loose spinning curtain 2.

As shown in FIG. 3, the spin-up device 51 includes, according to the second embodiment, an encircling device 35 which is able to encompass the molded bodies 3 in the loose molded body curtain 2 by means of a sling 36. By pulling the sling 36 tight, the molded bodies 3 are combined into the molded body bundle 4. The encircling device 35 is provided as an end effector 15 on the second manipulator arm 13 and performs the function of the bundling device 5.

The respective bundling device 5 of the spin-up devices 11 and 51 can be advanced and retracted between the spinnerets 7 and the spinning bath container 8 by means of the second manipulator arm 13, whereby the bundling device 5 can be displaced from a rest position 21 to a use position 22 as needed. Thus, the bundling device 5 can remain in the rest position 21 during the continuous extrusion of the molded bodies 3 and will not constitute an obstacle between the spinnerets 7 and the spinning bath container 8. If renewed spinning up of the spinning device 1 becomes necessary, then the bundling device 5 can be displaced to the use position 22 and permit the execution of a spin-up method according to the invention.

The inventive method for spinning up the spinning device 1, 101 is shown schematically in FIGS. 1 to 4. FIG. 1 shows the spinning device 1 and equivalently the spinning device 101, respectively, in the first step of the spin-up method. The molded bodies 3 are extruded from the spinnerets 7 in the form of a loose spinning curtain 2. After the extrusion of the molded bodies 3, they are increased in strength in at least some areas by means of a strengthening device 40. In doing so, an engagement area 29 is created on the molded bodies 3, where, after combining the molded bodies 3 into the molded body bundle 4, the molded body bundle can be grabbed and manipulated reliably by a gripper 16. In this case, the increase in strength of the molded bodies is achieved via a cooling device 41 and 42, respectively, by applying a cooling liquid 43 or a cooling air stream 44 to the molded bodies 3.

In a further step—as shown schematically in FIG. 2 or 3—the bundling device 5, more particularly the torsion means 18 and the turntable 31, respectively, at the spinning device 1, or the encircling device 35 at the spinning device 101, is positioned between the spinnerets 7 and the spinning bath container 8 such that the ends 23 of the extruded molded bodies 3 can be engaged by the bundling device 5.

In the first embodiment variant in FIG. 2, the molded body ends 23 adhere to the holding elements 24 and hooks 25, respectively, of the torsion means 18 formed as a turntable 31, thus increasing the adhesion between the molded bodies 3 and the torsion means 18 so that undesired gliding of the molded bodies 3 on the torsion means 18 is prevented. Preferably, the torsion means 18 is at standstill at the beginning of the method, however, it can also be put into rotation before the molded body ends 23 impinge on the torsion means 18. After the molded body ends 23 have impinged on the torsion means 18, the rotational velocity of the torsion means 18 will be increased until a predetermined final velocity is reached. This can, for example, be done in steps or continuously according to a predefined acceleration profile. The rotation of the torsion means 18 causes the spinning curtain 2 to be twisted around the torsion axis 20 which is preferably located parallel to the extrusion direction 32 of the molded bodies 3 and passes through the center of the spinning curtain 2. By virtue of the torsion of the spinning curtain 2, the molded body bundle 4 is preferably created in the engagement area 29 in which the molded bodies 3 were increased in strength.

In the second embodiment variant in FIG. 3, the molded body ends 23 are moved through the opened sling 36 of the encircling device 35. Then, the sling 36 is pulled tight, and the molded bodies 3 are combined into the molded body bundle 4. In this case, the molded body bundle 4 is again created in the engagement area 29 in which the molded bodies 3 were previously increased in strength.

FIGS. 2 and 3, respectively, show the spinning device 1 and 101, respectively, after the bundling device 5 has been displaced from its rest position 21 to its use position 22 by means of the second manipulator arm 13 and positioned between the spinnerets 7 and the spinning bath container 8. Then, the spinning curtain 2 was, as described hereinabove, produced in a second method step by means of the bundling device 5, and, consequently, the molded body bundle 4 was created. Subsequently, the molded body bundle 4 can then be provided in a draw-off member 10 of the spinning device 1, 101.

In this case, FIG. 4 shows the last method step, wherein the molded body bundle 4 held reliably by the gripper 16 is first transported through the spinning bath 9 around a deflection member 26 in the spinning bath container 8 by means of the first manipulator arm 12. Due to the increased strength of the molded bodies in the engagement area 29 on the molded body bundle 4, a reliable manipulation of the molded body bundle 4 can be carried out and rupturing of individual molded bodies 3 during the manipulation can be avoided. Subsequently, the molded body bundle 4 is moved out of the spinning bath container 8 again and inserted into the draw-off member 10 that particularly consists of a row of juxtaposed draw-off godets 10. Following the insertion of the molded body bundle 4 into the draw-off member 10, a continuous extrusion of the molded bodies 3 from the spinnerets 7 is possible, and the spin-up process has thus been completed successfully.

What is claimed is:

1. A method for spinning up a spinning device for the continuous extrusion of molded bodies from a spinning solution comprising a solvent and cellulose dissolved in the solvent, wherein the molded bodies are extruded from the spinning solution through spinnerets of the spinning device in the form of a loose spinning curtain, the molded bodies of the loose spinning curtain are twisted around a torsion axis via a rotating member are combined into a molded body bundle after the extrusion, and the molded body bundle is, in a further step, fed to a draw-off member of the spinning device in order to start a continuous extrusion of the molded bodies, wherein the tensile strength of the molded bodies of the loose spinning curtain, after their extrusion and before combining them into a molded body bundle, is increased in at least some areas, wherein an automatic gripper grabs the molded body bundle and feeds it to the draw-off member of the spinning device by machinery, and wherein the rotating device, draw-off member and automatic gripper are configured to spin-up the spinning device.

2. The method according to claim 1, wherein the tensile strength of the molded bodies is increased in at least some areas such that the molded bodies will substantially not rupture due to their own weight.

3. The method according to claim 1, wherein by virtue of the increase in tensile strength in at least some areas an engagement area is created on the molded body bundle, where the molded bodies have a viscosity that is increased as compared to the spinning solution.

4. The method according to claim 3, wherein the viscosity is increased 1.5-fold as compared to the spinning solution.

5. The method according to claim 1, wherein combining of the molded bodies into the molded body bundle and/or feeding the molded body bundle to the draw-off member is done by machinery.

6. The method according to claim 1, wherein the automatic gripping device grabs the molded body bundle in an engagement area.

7. The method according to claim 1, wherein the molded bodies, after their extrusion, are cooled in order to increase their tensile strength.

8. The method according to claim 7, wherein the temperature of the molded bodies after cooling by at least 10° C. is lower than the temperature of the spinning solution.

9. The method according to claim 8, wherein the temperature of the molded bodies after cooling by at least 20° C. is lower than the temperature of the spinning solution.

10. The method according to claim 7 wherein the cooling of the molded bodies is carried out by blowing a cooling air stream at least some areas thereof.

11. The method according to claim 7 wherein the cooling of the molded bodies is carried out by spraying at least some areas with a cooling liquid or by immersing at least some areas in a cooling.

12. The method according to claim 11, wherein the cooling liquid contains a coagulant for the dissolved cellulose.

13. The method according to claim 11, wherein the cooling liquid is an aqueous solution.

14. The method according to claim 1, wherein the molded bodies are combined into the molded body bundle by machinery by one or a combination of several of the following steps:

torsion of the spinning curtain around a torsion axis, encircling the spinning curtain with a sling and pulling the sling tight, or passing the spinning curtain through a funnel of decreasing cross-section.

15. The method according to claim 1, wherein the automatic gripper is a gripper on a manipulator arm.

16. A spin-up device for spinning up a spinning device comprising a bundling device for bundling of molded bodies extruded from the spinnerets of the spinning device into a molded body bundle, wherein the bundling device includes a rotating member that is configured to twist the molded bodies around a torsion axis to combine the molded bodies into the molded body bundle, wherein the spin-up device includes a first manipulator arm with a first end effector, the first end effector including a gripper configured to grab the molded body bundle, and wherein the bundling device and manipulator arm are configured to spin-up the spinning device.

17. The spin-up device according to claim 16, wherein the spin-up device includes a second manipulator arm with a second end effector, the second end effector including the bundling device.

18. The spin-up device according to claim 16, wherein the rotating member is a turntable.

19. A spinning device for the continuous extrusion of molded bodies, which comprises at least a spinning bath container comprising spinning bath, spinnerets associated with the spinning bath container for the extrusion of the molded bodies from the spinnerets into the spinning bath, and a spin-up device for spinning up the spinning device according to claim 16.

20. The spinning device according to claim 19, wherein the spinning device comprises a cooler, for increasing the strength of the extruded molded bodies in at least some areas.

21. The spinning device of claim 19, wherein the spinning device is for the extrusion of cellulosic molded bodies from a spinning solution comprising water, cellulose, and tertiary amine oxide.

22. The spinning device according to claim 19, wherein the spinning device comprises a coagulant applicator, for increasing the strength of the extruded molded bodies in at least some areas.

* * * * *